US005261489A

United States Patent [19]

Jennings, Jr. et al.

[11] Patent Number: 5,261,489

[45] Date of Patent: Nov. 16, 1993

[54] TWO WELL HYDROCARBON PRODUCING METHOD

[75] Inventors: Alfred R. Jennings, Jr., Plano; Malcolm K. Strubhar, Irving, both of Tex.

[73] Assignee: Mobil Oil Corporation, Fairfax, Va.

[21] Appl. No.: 946,219

[22] Filed: Sep. 17, 1992

[51] Int. Cl.[5] ..... E21B 43/26

[52] U.S. Cl. ..... 166/263; 166/271; 166/308

[58] Field of Search ..... 166/263, 271, 308

[56] References Cited

U.S. PATENT DOCUMENTS

| | | | |
|---|---|---|---|
| 2,952,449 | 9/1960 | Bays | 166/271 X |
| 2,966,346 | 12/1960 | Huitt et al. | 166/308 |
| 3,547,198 | 12/1970 | Slusser | 166/284 |
| 3,709,295 | 1/1973 | Braunlich, Jr. et al. | 166/271 X |
| 3,990,514 | 11/1976 | Kreinin et al. | 166/271 |
| 4,005,750 | 2/1977 | Shuck | 166/308 |
| 4,067,389 | 1/1978 | Savins | 166/246 |
| 4,718,490 | 1/1988 | Uhri | 166/281 |
| 4,724,905 | 2/1988 | Uhri | 166/250 |
| 4,830,106 | 5/1989 | Uhri | 166/308 X |

*Primary Examiner*—George A. Suchfield

*Attorney, Agent, or Firm*—Alexander J. McKillop; George W. Hager, Jr.; Henry L. Ehrlich, Jr.

[57] ABSTRACT

This specification discloses a method of hydraulic fracturing a subterranean formation wherein two horizontally spaced-apart wells are provided and completed to communicate with the formation. Hydraulic fluid pressure is sequentially applied to create and propagate vertical fractures into the formation and to create a vertical fracture that communicates both wells. This specification further disclosed the creation of an enhanced fracture drainage pattern in a hydrocarbon-bearing formation and producing hydrocarbons from the formation via a single producing well.

2 Claims, 1 Drawing Sheet

TWO WELL HYDROCARBON PRODUCING METHOD

FIELD OF THE INVENTION

This invention relates to an enhanced method of sequentially hydraulic fracturing a subsurface earth formation. This invention further relates to a method of producing hydrocarbons from a subsurface hydrocarbon-bearing formation.

BACKGROUND OF THE INVENTION

This invention is concerned with an enhanced method of sequentially hydraulic fracturing a subsurface formation. This invention is also concerned with a method of producing hydrocarbons from a hydrocarbon-bearing formation that has been fractured by using an enhanced sequential hydraulic fracturing method.

Hydraulic fracturing techniques have been widely used for stimulating wells penetrating subsurface or subterranean hydrocarbon-bearing formations by creating fractures which extend from the wells into the formation. These techniques normally involve injecting a fracturing fluid down a well and into contact with the subterranean formation to be fractured. A sufficiently high pressure is applied to the fracturing fluid to initiate a fracture in the formation and the fracturing fluid is injected down the well at a sufficiently high rate to propagate the fracture thereinto. Propping materials are normally entrained in the fracturing fluid and are deposited in the fracture to maintain the fracture open.

In U.S. Pat. No. 4,067,389 there is described a technique of hydraulically fracturing a subterranean formation wherein there is used a fracturing fluid comprised of an aqueous solution of an interaction product of a polysaccharide and a galactomannan.

In U.S. Pat. No. 3,547,198 there is described a method of forming two vertically disposed fractures communicating with a well equipped with a casing and which well penetrates a subterranean earth formation having a known preferred fracture orientation.

In U.S. Pat. No. 4,724,905 there is described a process for sequentially hydraulic fracturing a hydrocarbon-bearing formation penetrated by two closely spaced wells. In sequential hydraulic fracturing, the direction that a hydraulic fracture will propagate is controlled by altering the local in-situ stress distribution in the vicinity of a first wellbore. By this method, a hydraulic fracturing operation is conducted at the first wellbore wherein hydraulic pressure is applied to the formation sufficient to cause a hydraulic fracture to form perpendicular to the least principal in-situ stress.

While maintaining pressure in this first hydraulic fracture, a second hydraulic fracture is initiated in a second wellbore. This second hydraulic fracture, due to the alteration of the local in-situ stresses by the first hydraulic fracture, will initiate at an angle, possibly perpendicular, to the first hydraulic fracture.

SUMMARY OF THE INVENTION

This invention is directed to technique of fracturing a subterranean formation werein two spaced apart wells are provided and completed in a subterranean formation such as a hydrocarbon-bearing formation. A modified sequential hydraulic fracturing technique is utilized to create three vertical fractures one of which establishes fluid communication between the wells such that all three vertical fractures communicate with the two wells. When these wells and fractures are formed in a hydrocarbon-bearing formation an enhanced drainage pattern is established. One well is thereafter shut in and the other well is use as a single producing well to produce hydrocarbons from the formation utilizing the enhanced drainage pattern.

DESCRIPTION OF THE PREFERRED EMBODIMENTS

This invention is directed to a technique of hydraulic fracturing a subterranean or subsurface formation. This invention is also directed to a technique of producing hydrocarbons from a hydrocarbon-bearing formation that has been hydraulically fractured in accordance with this invention.

In U.S. Pat. No 4,724,905 to Uhri there is described a process for sequential hydraulic fracturing a hydrocarbon fluid-bearing formation. The techniques of Uhri are applicable to the present invention, though the present invention requires certain variations and modifications to Uhri in order to accomplish the purposes and benefits of the invention.

In accordance with this invention a subterranean formation which may be a hydrocarbon-bearing formation is hydraulically fractured by utilizing a modified sequential hydraulic fracturing technique. Known hydraulic fracturing fluids that are comprised of liquids may be used in this invention. Examples of such fracturing fluids are water, crude oil, diesel oil and acids. These fluids may be used in basic form or in combination with chemical agents such as guar gums, derivatized guars, synthesized agents such as carboxymethyl cellulose, organic esters and fatty acids, as examples. In addition, heavy metal salts including borates, zirconates, chromates, and aluminates may be added to complex or crosslink these gels to further viscosity. These and many others known to those skilled in the art, including emulsified and foamed variations, may be used in sequential hydraulic fracturing.

Preferred fracturing fluids for use in carrying out this invention are those systems which generate the maximum net fracturing pressure (pressure above the maximum stress) such as crosslinked guars and derivatized guars, crosslinked synthesized cellulose systems such as carboxymethyl cellulose and carboxymethyl hydroxyethyl cellulose, and ore-water emulsion systems.

Figure 1:
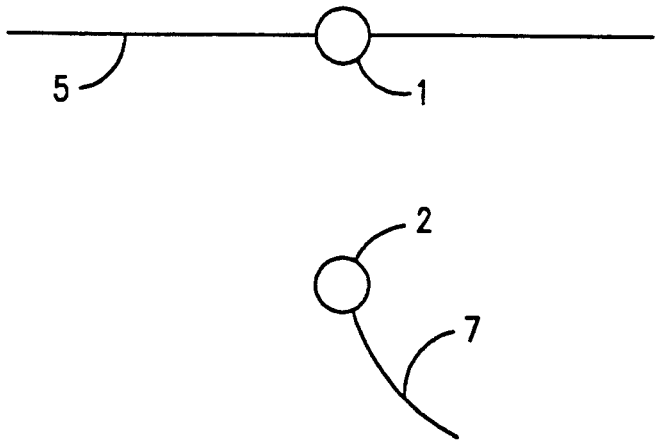
FIG. 1 illustrates an embodiment of this invention involving sequential hydraulic fracturing treatment conducted in Wells 1 and 2.

For a more detailed description of this invention reference is made to FIG. 1 wherein there is shown a plan view of the earth surface 3. A first well 1 and a second well 2 spaced horizontally apart one from the other are provided by drilling and completing in a conventional manner to extend from the earth surface 3 and to penetrate and communicate with a subterranean formation of interest, not shown. Hydrocarbon-bearing formations are often times such formations of interest. Hydraulic fluid pressure is applied in said first well 1 in an amount sufficient to initiate and propagate a first vertical fracture 5 that propagates essentially in a direction perpendicular to the direction of the least principal in-situ stress of the formation. Concomitantly hydraulic pressure is applied via well 2 to the subterranean formation of interest in an amount and at a pressure sufficient to initiate and propagate a second vertical fracture 7 from well 2 into the formation of interest in a direction away from and transverse to the first vertical fracture 5

Figure 2:
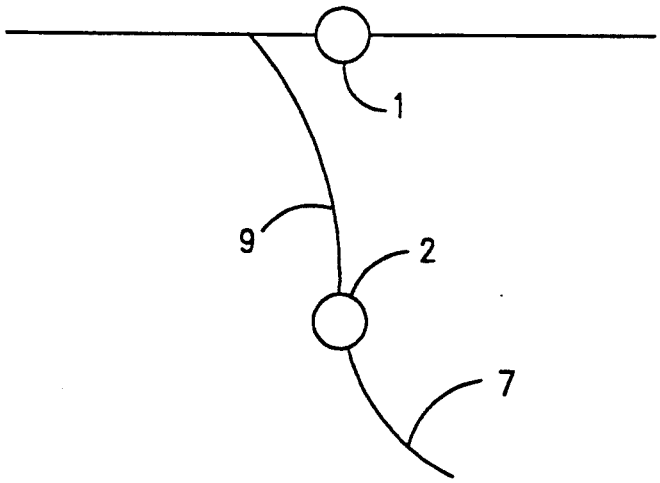
FIG. 2 illustrates a further embodiment of this invention involving forming a fracture that communicates between Well 1 and Well 2.
Figure 3:
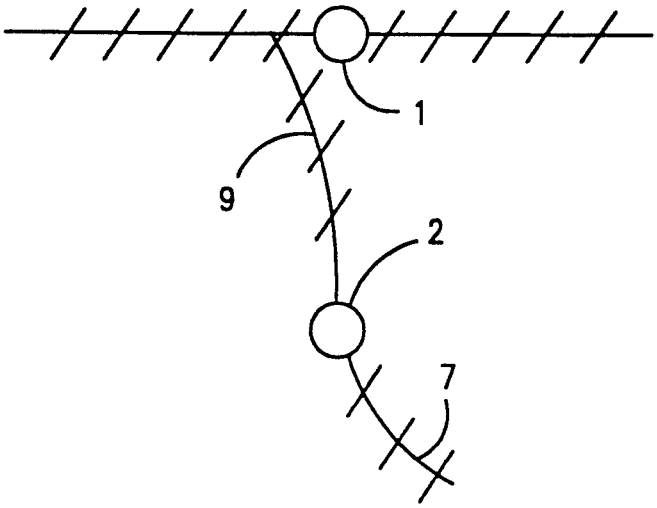
FIG. 3 illustrates other embodiments of this invention.

With reference now to FIG. 2 the first well 1 is shut-in after the second vertical fracture 7 has been propagated into the formation of interest to essentially its desired length. The application of hydraulic fluid pressure via well 2 to the formation of interest is continued to extend and propagate a vertical fracture 9 to intersect vertical fracture 5 or well 1 thus establishing fluid communication between wells 1 and 2. Fluids are thereafter allowed to flow back from the formation of interest via vertical fractures 5, 7 and 9 into wells 1 and 2 for a sufficient flowback time period to cleanup fractures 5, 7, and 9. It should be noted, though it is apparent from the description above, that the illustration of the fractures in FIGS. 1, 2, and 3 are traces of the fractures on the plan views and the FIGS. 1, 2, and 3 and the wells, fractures and drainage pattern shown therein are schematic views used to illustrate the principles of the invention. As noted above, the formation into which the wells are completed to communicate with are not shown.

Also as noted above the subterranean formation being fractured is oftentimes if not usually a hydrocarbon-bearing formation.

This invention is further directed to the creation of an enhanced fracture drainage pattern in a hydrocarbon-bearing formation and producing hydrocarbons from the formation via a single producing well. As schematically illustrated in FIG. 3 a fracture pattern is formed in a hydrocarbon-bearing formation utilizing the technique described above. Thereafter well 2 is shut-in and well 1 is utilized as a single producing well to produce hydrocarbons from the formation utilizing the enhanced drainage pattern formed by the fracture pattern and as there illustrated. Alternative producing options include shutting in well number 2 and producing from well number 1 or producing from both wells.

The wells will be cased and perforated as a preferred completion prior to fracturing operations. In some circumstances open hole completions may be utilized as an alternative. In cased completions, any perforating pattern may be used. In a preferred embodiment, perforations of at least two shots or more per foot of interval will be used with 90° phasing between alternate shots with the perforations aligned with the anticipated directions of the various fractures to be propagated.

Having described specific embodiments of the instant invention, it will be understood that further modifications thereof may be suggested to those skilled in the art, and it is intended to cover all such modifications as fall within the scope of the appended claims.

What is claimed is:

1. A method of fracturing a subterranean formation comprising:

(a) providing a first well that extends from the surface of the earth and is completed to communicate with said formation;

(b) providing a second well that extends from the surface of the earth, said second well being spaced horizontally apart from said first well and said second well being completed to communicate with said formation;

(c) applying fluid pressure in said first well sufficient to initiate and propagate a first vertical fracture from said first well into said formation from said first well;

(d) applying fluid pressure in said second well sufficient to initiate a second vertical fracture from said second well and to propagate said second vertical fracture into said formation in a direction away from and transverse to said first fracture;

(e) subsequent to step (d) shutting in said first well;

(f) continuing the application of fluid pressure in said second well sufficient to propagate a third vertical fracture into said formation from said second well in a direction toward said first fracture and to establish communication with said first well; and (g) flowing back fluids from said formation through said fractures and into said wells to clean said fractures.

2. A method of producing hydrocarbons from a hydrocarbon-bearing formation comprising:

(a) providing a first well that extends from the surface of the earth and is completed to communicate with said formation;

(b) providing a second well that extends from the surface of the earth, said second well being spaced horizontally apart from said first well and said second well being completed to communicate with said formation;

(c) applying fluid pressure in said first well sufficient to initiate and propagate a first vertical fracture from said first well into said formation from said first well;

(d) applying fluid pressure in said second well sufficient to initiate a second vertical fracture from said second well and to propagate said second vertical fracture into said formation in a direction away from and transverse to said first fracture;

(d) shutting in said first well;

(f) continuing the application of fluid pressure in said second well sufficient to propagate a third vertical fracture into said formation from said second well in a direction toward said first fracture and to establish communication with said first well;

(g) flowing back fluids from said formation through said fractures and into said wells to clean said fractures;

(h) shutting-in said second well; and (i) opening for production said first well and producing hydrocarbons from said hydrocarbon bearing formation via said first, second and third fractures.

* * * * *